US008220879B2

(12) United States Patent
Chen et al.

(10) Patent No.: US 8,220,879 B2
(45) Date of Patent: Jul. 17, 2012

(54) INTERLOCKING DEVICE FOR SLIDE RAIL

(75) Inventors: Wan-Lai Chen, Taipei County (TW); Tsung-Po Chang, Taipei County (TW)

(73) Assignee: Martas Precision Slide Co., Ltd., Taipei County (TW)

( * ) Notice: Subject to any disclaimer, the term of this patent is extended or adjusted under 35 U.S.C. 154(b) by 366 days.

(21) Appl. No.: 12/689,475

(22) Filed: Jan. 19, 2010

(65) Prior Publication Data

US 2011/0176755 A1 Jul. 21, 2011

(51) Int. Cl.
*A47B 88/04* (2006.01)
*E05B 65/46* (2006.01)

(52) U.S. Cl. ..... 312/221; 312/217; 312/334.47

(58) Field of Classification Search ..... 312/216, 312/217, 219, 220, 221, 107.5, 330.1, 334.1, 312/334.7, 334.44, 334.47
See application file for complete search history.

(56) References Cited

U.S. PATENT DOCUMENTS

| | | | | |
|---|---|---|---|---|
| 3,799,638 | A * | 3/1974 | Faiks | 312/216 |
| 3,941,441 | A * | 3/1976 | Scheerhorn | 312/215 |
| 5,199,774 | A * | 4/1993 | Hedinger et al. | 312/219 |
| 5,427,445 | A * | 6/1995 | Mitchell | 312/221 |
| 7,850,259 | B2 * | 12/2010 | Chen et al. | 312/221 |
| 2004/0100165 | A1 * | 5/2004 | Hoffman | 312/219 |
| 2004/0100166 | A1 * | 5/2004 | Hoffman | 312/219 |
| 2006/0267461 | A1 * | 11/2006 | Hoffman | 312/219 |
| 2007/0013274 | A1 * | 1/2007 | Hoffman | 312/219 |

* cited by examiner

*Primary Examiner* — James O Hansen
(74) *Attorney, Agent, or Firm* — Rosenberg, Klein & Lee

(57) ABSTRACT

An interlocking device for a slide rail is connected with other interlocking devices through a cable. The interlocking device has a sliding block and a rotary disc disposed on a fixed base. The rotary disc is disposed thereon with a stop block. The sliding block and the stop block are connected with the rotary disc respectively by second springs to link each other. The stop block is connected with a pulley of a slide rail. The sliding block is connected with the cable so that when the slide rail slides outward, the slide rail drives the stop block, the rotary disc, and the sliding block to move synchronously. After the pulley is separated from the stop block, the cable is drawn tightly by the sliding block to lock the other interlocking devices.

5 Claims, 7 Drawing Sheets

INTERLOCKING DEVICE FOR SLIDE RAIL

BACKGROUND OF THE INVENTION

1. Field of the Invention

The present invention relates to the field of drawer slide rail structures, and more particularly to an interlocking device coupled to a slide rail structure.

2. Description of the Related Art

Mostly, a plurality of drawers are longitudinally arranged up and down in a conventional cabinet, desk or file cabinet to allow articles or documents to be stored by their categories. Corresponding slide rail structures are arranged between the drawers and the cabinet body for pushing and pulling the drawer to easily access the articles or documents therein. However, after articles or documents are placed in each drawer, it will become extremely heavy. Although it is easy to push and fully pull these drawers out, the gravity center position of the cabinet will change after several drawers are pulled out at the same time. This may result in potential hazards because persons are hurt or articles are crushed as the cabinet topples over. Therefore, safety regulations have been established in many countries to request that interlocking devices must be provided between such drawers to ensure the safety in use.

Structural designs of various interlocking devices are slightly different form each other. When the drawers are opened and closed one by one, the interlocking device can reliably lock the other slide rails, so as to prevent the other drawers from being opened or sliding out from the cabinet body. However, when a drawer is closed, most of such interlocking devices may be damaged and must be repaired or replaced because the drawer is not pushed into a correct predetermined position. Therefore, conventional interlocking devices are imperfect and need to be improved.

SUMMARY OF THE INVENTION

An object of the present invention aims to provide an interlocking device for a slide rail so as to reliably achieve the locking effect. The design of return mechanism enables fast recovery of the original service function.

To achieve this object, an interlocking device for a slide rail of the present invention is fixedly mounted, on the end of a slide rail and connected with other interlocking devices through a cable, so that after the slide rail is actuated, the other slide rails are locked. The interlocking device comprises: a fixed base fixedly mounted on the end of the slide rail, a first rail and a second rail being provided in parallel on the fixed base, an engagement portion being provided on one end of the second rail, a first hook portion being provided adjacent to the first rail, and a return groove being provided at one side of the second rail; a sliding block disposed within the first rail, a first hook being provided on one end portion of the sliding block to allow the cable to pass through, a hook post being provided on the other end portion of the sliding block; a rotary disc disposed within the second rail, the rotary disc being provided with a through hole to allow the hook post to be hooked therein, a second hook portion and a third hook portion being provided adjacent to the through hole, a position-limiting portion being provided at one side of the through hole, and a pivotal connection portion being provided at one side of the position-limiting portion; a stop block, one end portion thereof being pivotally connected to the pivotal connection portion of the rotary disc so that the stop block swings around the position-limiting portion as a fulcrum, a fourth hook portion being provided adjacent to the pivotal connection portion, an engaging portion being provided on the other end portion of the stop block to allow a pulley of the slide rail to be placed therein, so as to drive the stop block, the sliding block, and the rotary disc to move synchronously; and a first spring and a second spring disposed respectively between the first hook portion and the third hook portion and between the second hook portion and the fourth hook portion to drive the stop block, the rotary disc, and the sliding block to be returned back to the original positions; whereby when the slide rail hooks and moves the stop block, it synchronously drives the rotary disc to slide and rotate and drives the sliding block to slide, and thus the cable is drawn tightly to lock other slide rails. Moreover, at least one pair of second hooks are further provided on one side of the fixed base to allow the cable to pass through.

In one embodiment, a stop plate is further provided on one end of the fixed base adjacent to the return groove to stop the rotary disc. When the stop block is pushed inward by the incorrectly positioned pulley, the rotary disc is stopped and thus the stop block falls into the return groove to enable the position-limiting portion to be inclined such that the pulley is returned back to the original position again.

DETAILED DESCRIPTION OF THE PREFERRED EMBODIMENTS

Figure 1:
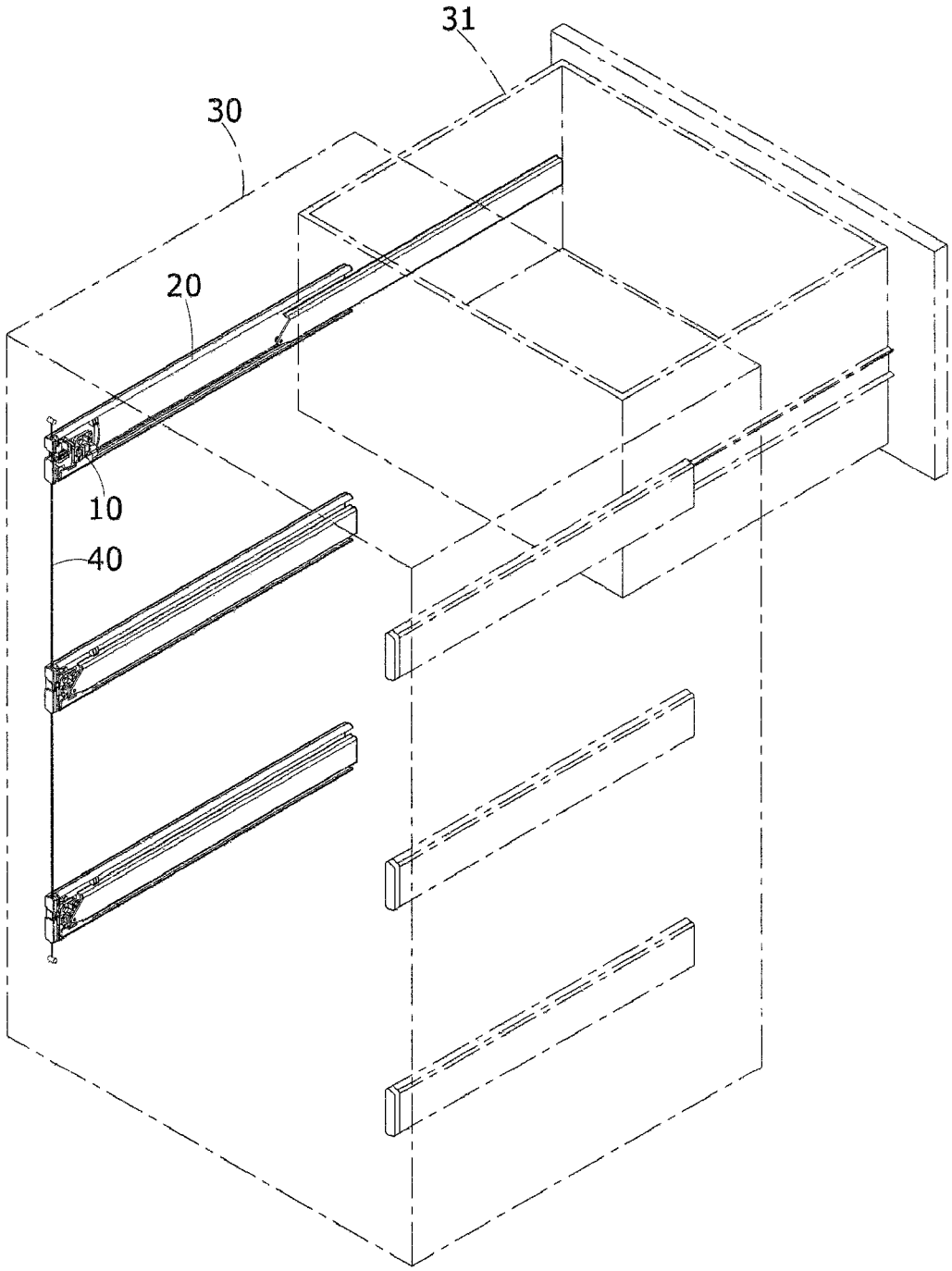
FIG. 1 is a schematic view showing installation according to a preferred embodiment of the present invention.
Figure 2:
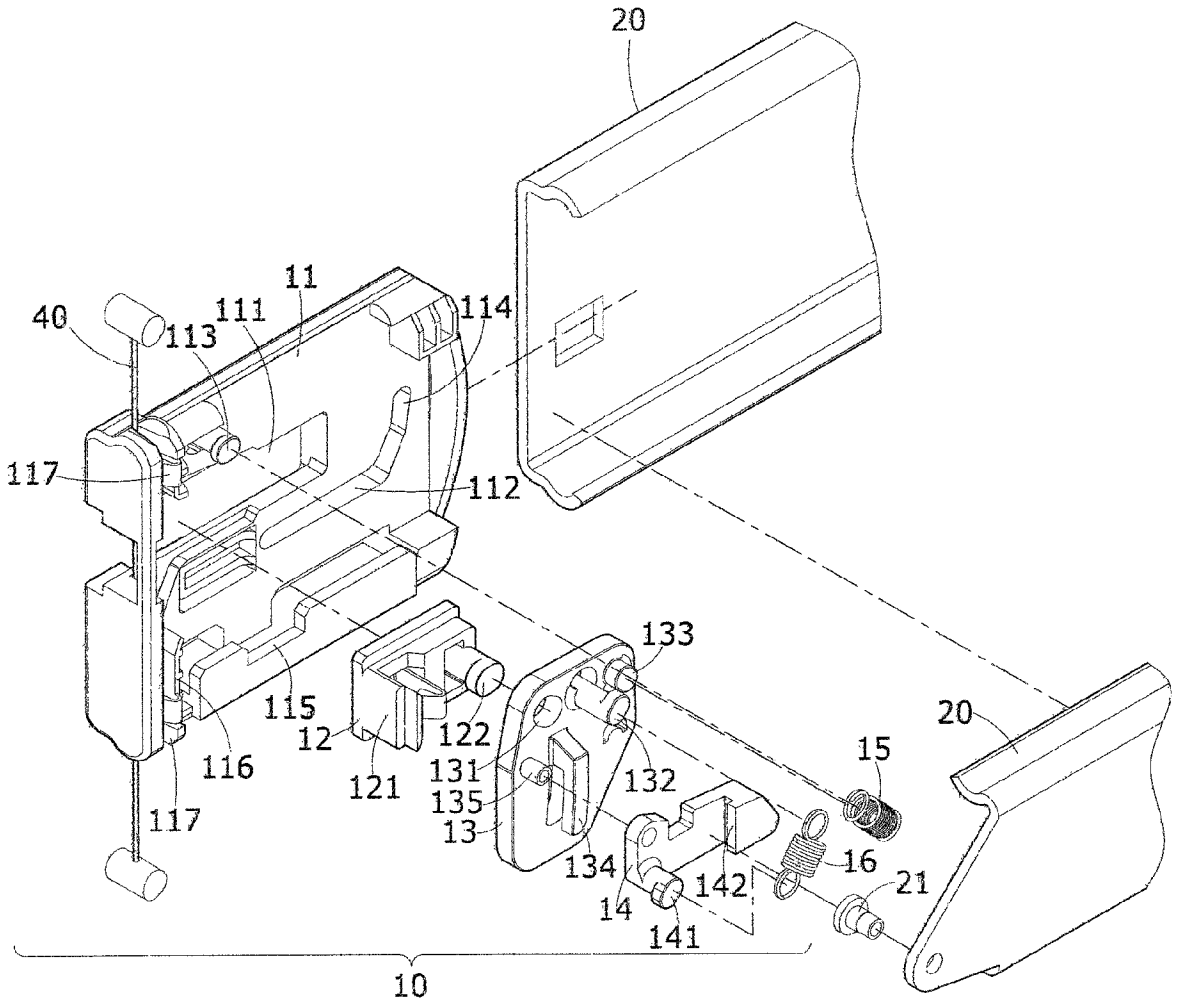
FIG. 2 is a three-dimensional exploded view according to a preferred embodiment of the present invention.
Figure 3:
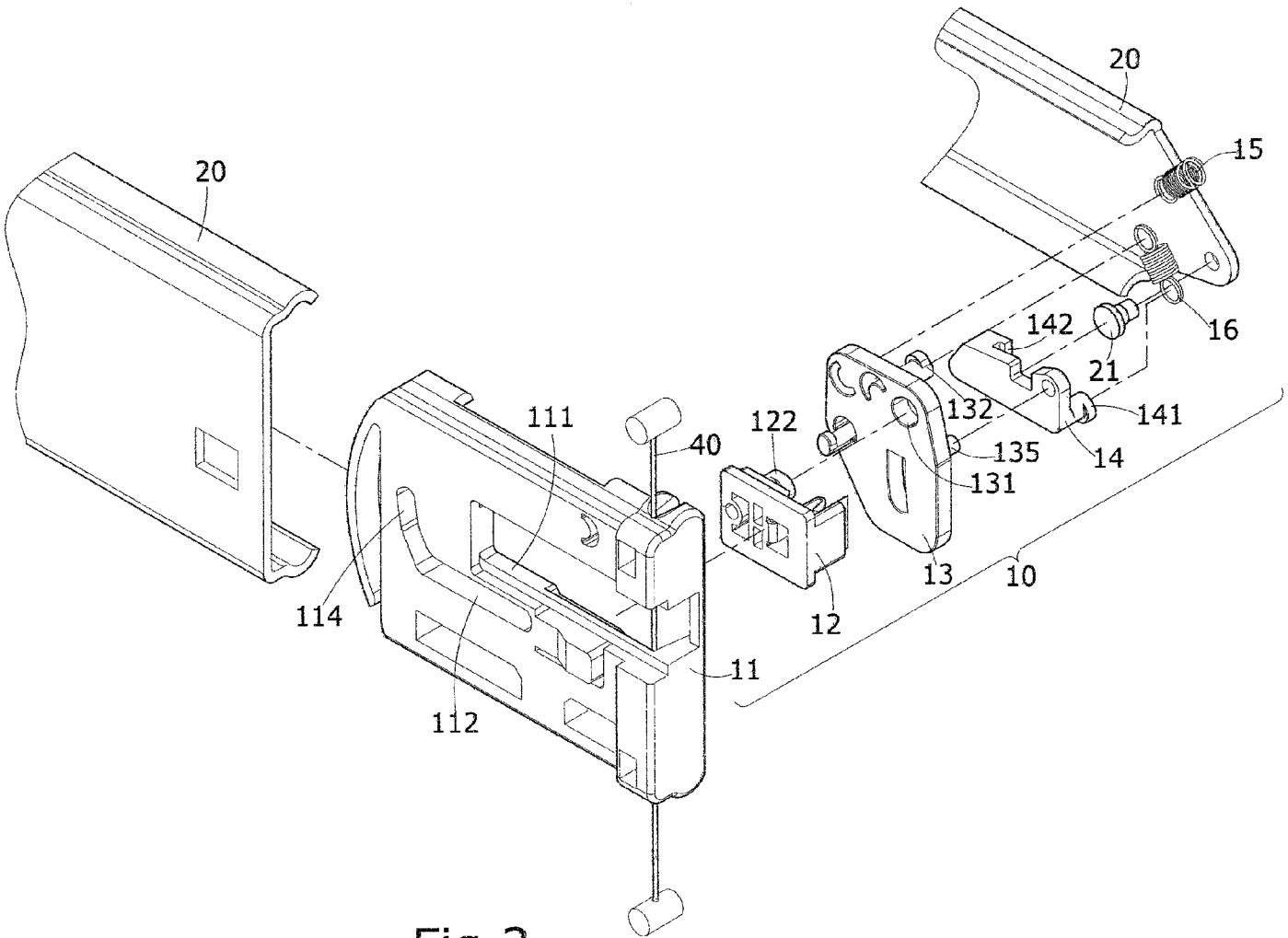
FIG. 3 is a three-dimensional exploded view of according to preferred embodiment of the present invention from another view angle.
Figure 4:
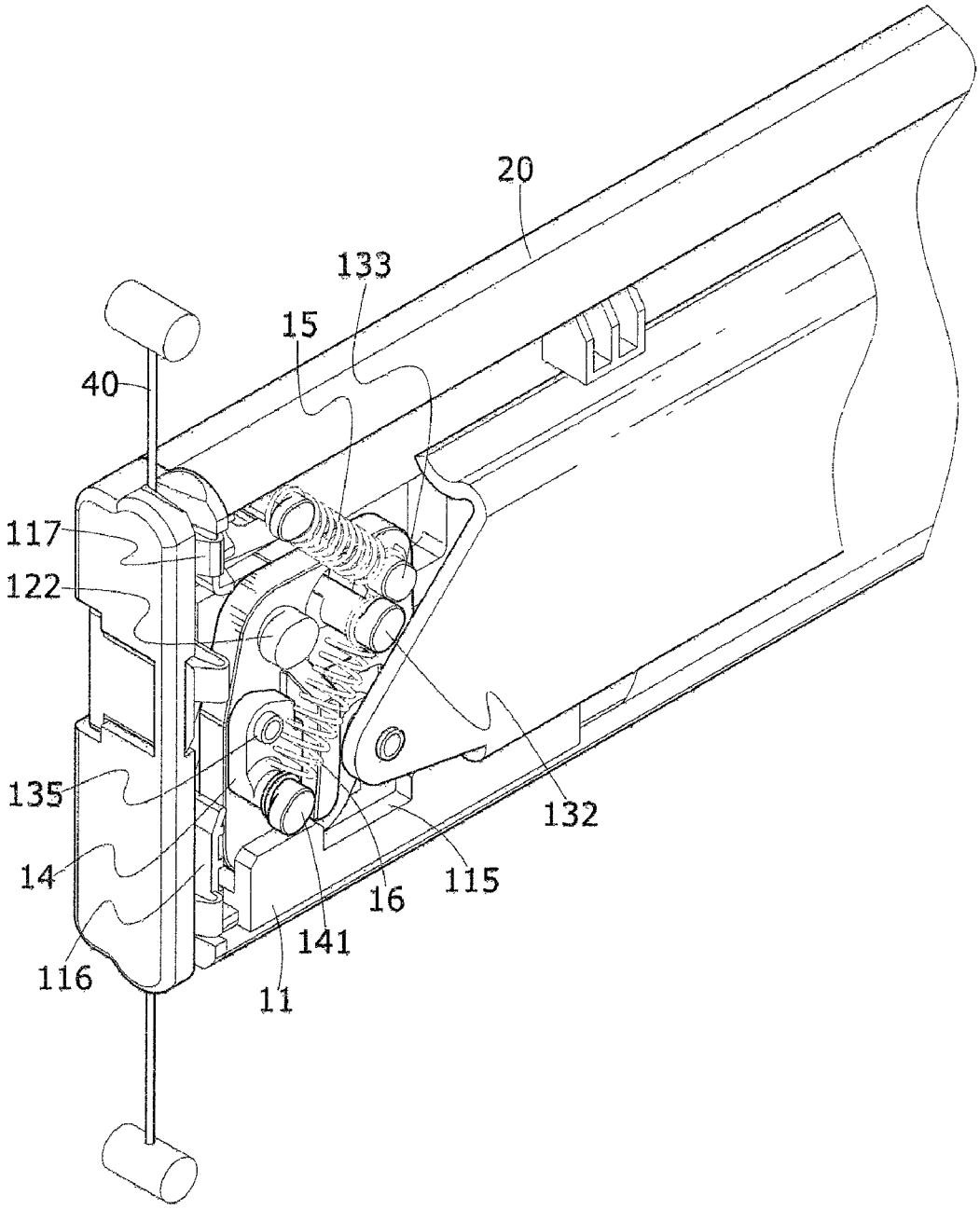
FIG. 4 is a three-dimensional appearance view according to a preferred embodiment of the present invention after assembled.

The contents of the present invention will become more apparent from the following description when taken in conjunction with the drawings.

Referring to FIGS. 1 to 4, there are shown a schematic view showing installation and a three-dimensional exploded view according to a preferred embodiment of the present invention, a three-dimensional exploded view according to a preferred embodiment of the present invention from another view angle, and a three-dimensional appearance view according to a preferred embodiment of the present invention after assembled. As shown in these figures, an interlocking device 10 for a slide rail of the present invention is fixedly mounted on the end of a slide rail 20. The slide rails 20 are plurally arranged up and down in a cabinet 30. Each slide rail 20 is connected with a drawer 31 and connected with the interlocking devices 10 on the other slide rails 20 through a cable 40, so that after one of the slide rails 20 is actuated, the other slide rails 20 are locked. The interlocking device 10 mainly comprises a fixed base 11, a sliding block 12, a rotary disc 13, a stop block 14, a first spring 15 and a second spring 16.

The fixed base 11 is fixedly mounted, on the end of the slide rail 20. A first rail 111 (located at an upper portion) and a second rail 11.2 (located at a lower portion) are provided in parallel on the fixed base 111. The length of the first rail 111 is less than the length of the second rail 112. A first hook portion 113 is provided on the fixed base 11 adjacent to the first rail 111 to allow the first spring 15 to be hooked thereon. An engagement portion 114 is provided on the right end of the second rail 112 and is arranged perpendicular to the second rail 112. A return groove 115 is provided under the second rail 112 to receive the stop block 14. A stop plate 116 is further provided at the left of the return groove 115 to stop the rotary disc 13. Moreover, at least one pair of second hooks 117 are provided on the left side of the fixed base 11 to allow the cable 40 to pass through.

The sliding block 12 is slidably disposed within the first rail 111. A first hook 121 is provided on the left end of the sliding block 12 to draw the cable 40, A hook post 122 is provided at left side end of the sliding block 12 for connecting with the rotary disc 13.

The rotary disc 13 is slidably disposed within the second rail 112. The rotary disc 13 is provided with a through hole 131 to allow the hook post 122 to be hooked therein. A second hook portion 132 and a third hook portion 133 are provided at the right of the through hole 131 to allow the first spring 15 and the second spring 16 to be respectively hooked thereon. A position-limiting portion 134 is provided under the through hole 131, and a pivotal connection portion 135 is provided at the left of the position-limiting portion 134.

The left end of the stop block 14 is pivotally connected to the pivotal connection portion 135 of the rotary disc 13 so that the stop block 14 swings around the position-limiting portion 134 as a fulcrum. A fourth hook portion 141 is provided under the pivotal connection position to allow the second spring 16 to be hooked thereon. An engaging portion 142 is provided on the right end of the stop block 14 for a pulley 21 of the slide rail 20 to be placed therein, so as to drive the stop block 14, the sliding block 12 and the rotary disc 13 to move synchronously.

The first spring 15 is hooked on the first hook portion 113 and the third hook portion 133 and the second spring 16 is hooked on the second hook portion 132 and the fourth hook portion 141 to provide the stop block 14, the rotary disc 13, and the sliding block 12 with restoring force when they are returned back to the original positions.

Figure 5:
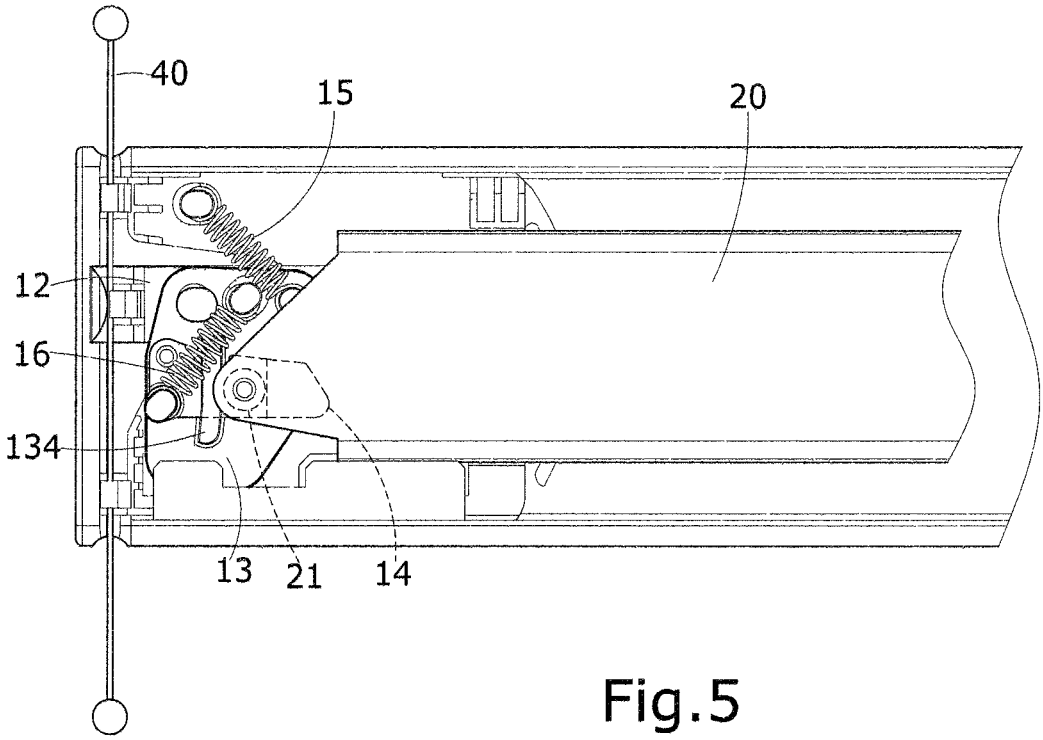
FIG. 5 is a schematic view (I) showing the action according to a preferred embodiment of the present invention when opening the drawer.
Figure 6:
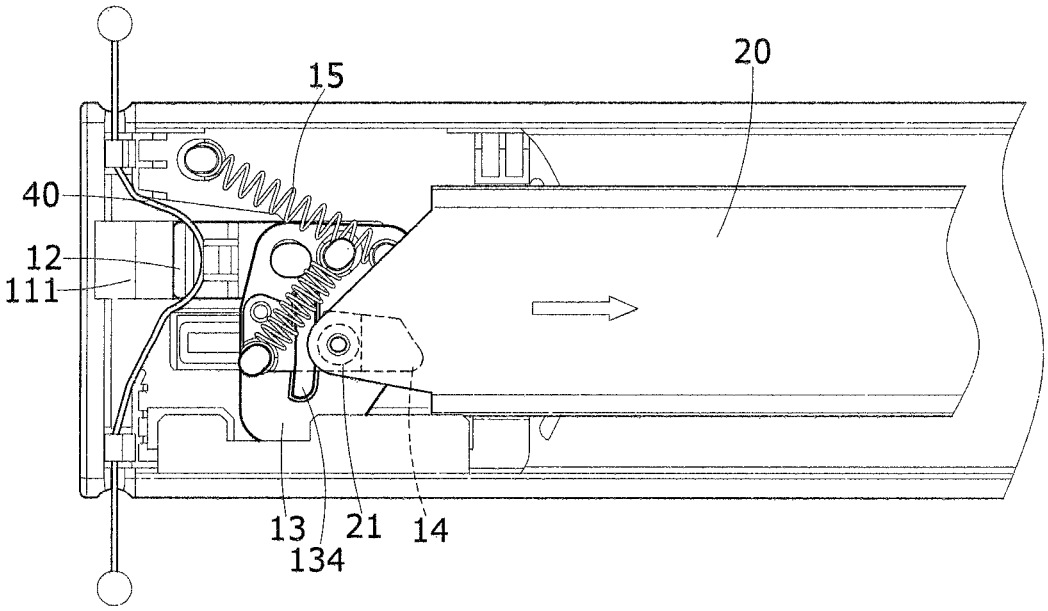
FIG. 6 is a schematic view (II) showing the action according to a preferred embodiment of the present invention when opening the drawer.
Figure 7:
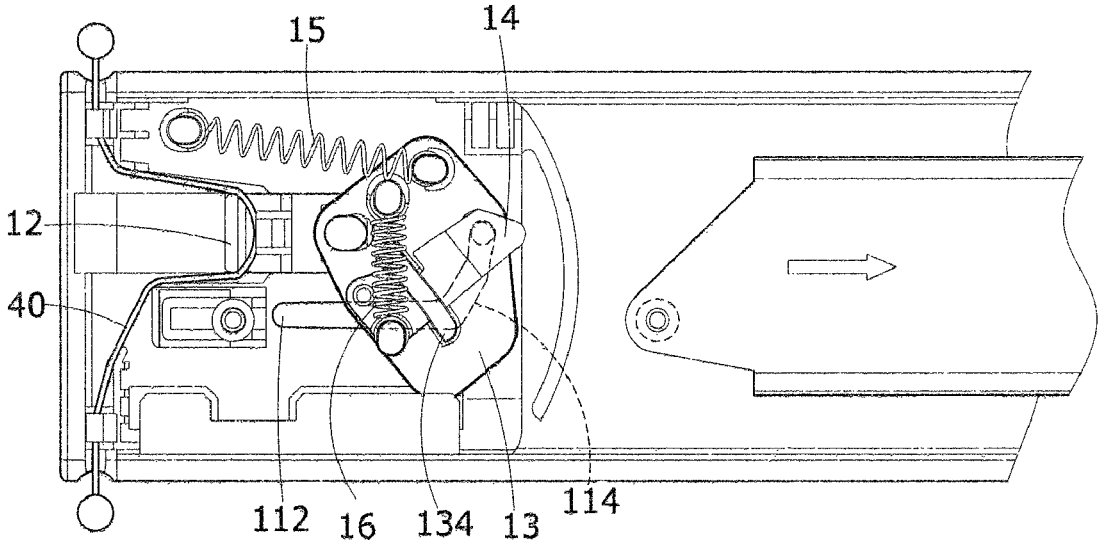
FIG. 7 is a schematic view (III) showing the action according to a preferred embodiment of the present invention when opening the drawer.

Referring to FIGS. 5 to 7, there are shown schematic views showing the action according to a preferred embodiment of the present invention when opening the drawer. As shown in these figures, when the slide rail 20 is moved outward, the pulley 21 of the slide rail 20 hooks and moves the stop block 14 so that the rotary disc 13 limitedly slides within the second rail 112, and synchronously drives the sliding block 12 to limitedly slide within the first rail 111, and thus draws the cable 40 to lock the other slide rails 20 (not shown). Then, after the sliding block 12 is stopped by the first rail 111, the first spring 15 acts on the rotary disc 13 to deflect the rotary disc 13 along the second rail 112 and thus the rotary disc 13 falls into the engagement portion 114 to allow the rotary disc 13 to be temporarily locked. Since the stop block 14 is acted by the second spring 16 and stopped by the position-limiting portion 134, the stop block 14 becomes inclined as the rotary disc 13 rotates, and the pulley 21 of the slide rail 20 can be separated from the position-limiting portion 134. On the contrary, when the slide rail 20 is moved inward, the pulley 21 hits the position-limiting portion 134 to reversely rotate the rotary disc 13. Through the action of the first spring 15 and the second spring 16, the stop block 14, the rotary disc 13, and the sliding block 12 are returned back to the original positions, and the slide rail 20 are automatically pulled back.

Figure 8:
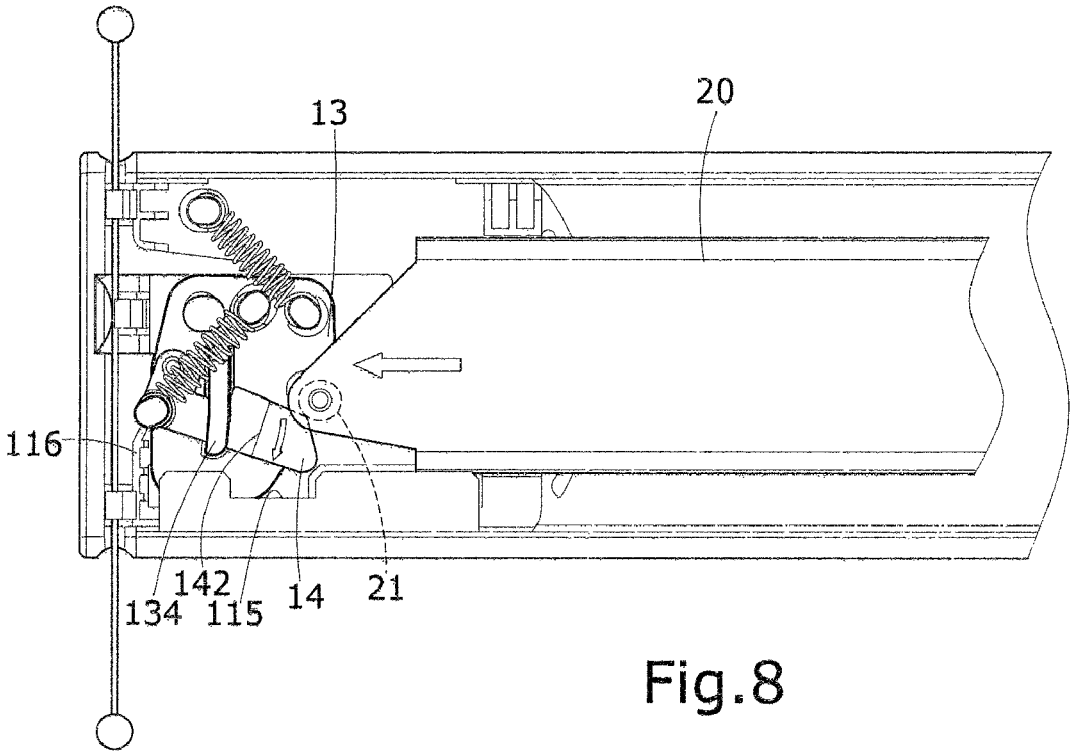
FIG. 8 is a schematic view (I) showing the action according to a preferred embodiment of the present invention when returning back to the original position.
Figure 9:
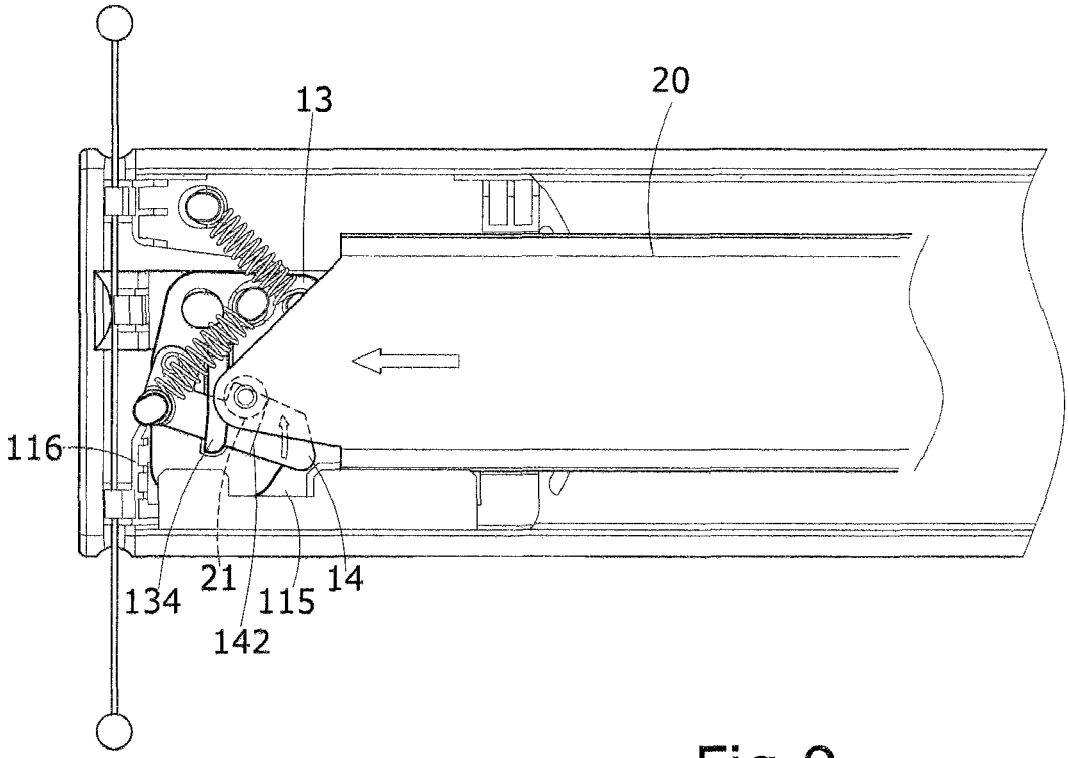
FIG. 9 is a schematic view (II) showing the action according to a preferred embodiment of the present invention when returning back to the original position.

Next, referring to FIGS. 8 and 9, there are shown schematic views showing the action according to a preferred embodiment of the present invention when returning back to the original position. As shown in these figures, when the stop block 14 is pushed inward by the incorrectly positioned pulley 21 (as shown in the figure, the pulley 21 hits the right edge of the stop block 14 and does not fall within the position-limiting portion 134), it synchronously pushes the rotary disc 13 until the rotary disc 13 is stopped by the stop plate 116. The stop block 14 is rotated downward and thus falls into the return groove 115. Then, after the stop block 14 has become inclined, the engaging portion 142 is exposed such that the pulley 21 falls within the position-limiting portion 134 again to achieve the returning effect. When the slide rail 20 is moved outward again, it returns to the as shown above in FIGS. 5 to 7 and thus will be explained in no more detail.

However, what are described above are only preferred embodiments of the invention and should not be used to limit the scope of the present invention, and therefore all equivalent or obvious variations and modifications made by those skilled in the art, such as materials and sizes of the fixed base, the sliding block, the rotary disc and the stop block, or pounds of the springs used, which do not depart from the spirit and scope of the present invention should be included in the appended claims.

In summarization of the foregoing description, the interlocking device for a slide rail according to the present invention meets the requirements of inventiveness and industrial applicability of patents, and the application for a utility model patent is duly filed accordingly.

What is claimed is:

1. An interlocking device for a slide rail, fixedly mounted on the end of a slide rail, connected with other interlocking devices through a cable, and after the slide rail is actuated, other slide rails are locked, the interlocking device comprising:

a fixed base, fixedly mounted on the end of the slide rail, a first rail and a second rail being provided in parallel on the fixed base, an engagement portion being provided on one end of the second rail, a first hook portion being provided adjacent to the first rail, and a return groove being provided at one side of the second rail;

a sliding block, disposed within the first rail, a first hook being provided on one end portion of the sliding block to allow the cable to pass through, a hook post being provided on the other end portion of the sliding block;

a rotary disc, disposed within the second rail, the rotary disc being provided with a through hole to allow the hook post to be hooked in the through hole, a second hook portion and a third hook portion being provided adjacent to the through hole, a position-limiting portion being provided at one side of the through hole, and a pivotal connection portion being provided at one side of the position-limiting portion;

a stop block, one end portion of the stop block being pivotally connected to the pivotal connection portion of the rotary disc so that the stop block swings around the position-limiting portion as a fulcrum, a fourth hook portion being provided adjacent to the pivotal connection portion, an engaging portion being provided on the other end portion of the stop block to allow a pulley of the slide rail to be placed in the engaging portion, so as to drive the stop block, the sliding block and the rotary disc to move synchronously; and a first spring and a second spring, disposed respectively between the first hook portion and the third hook portion and between the second hook portion and the fourth hook portion to drive the stop block, the rotary disc, and the sliding block to be returned back to the original positions; whereby when the slide rail hooks and moves the stop block, the slide rail synchronously drives the rotary disc to slide and rotate and drives the sliding block to slide, and thus draws the cable to lock the other slide rails.

2. The interlocking device for a slide rail as described in claim 1, wherein at least one pair of second hooks are further provided on one side of the fixed base to allow the cable to pass through.

3. The interlocking device for a slide rail as described in claim 2, wherein a stop plate is further provided on one end of the fixed base adjacent to the return groove to stop the rotary disc.

4. The interlocking device for a slide rail as described in claim 1, wherein a stop plate is further provided on one end of the fixed base adjacent to the return groove to stop the as rotary disc.

5. The interlocking device for a slide rail as described in claim 4, wherein when the stop block is pushed inward by the incorrectly positioned pulley, the stop block falls into the return groove to enable the position-limiting portion to be inclined such that the pulley is returned back to the original position again.

* * * * *